United States Patent [19]

Krug et al.

[11] Patent Number: 5,017,065

[45] Date of Patent: May 21, 1991

[54] RETRACTABLE RAILCAR HITCH

[75] Inventors: John A. Krug; James C. Hammonds; Kenneth D. Schmidt, all of St. Charles; Dennis F. Paglusch, St. Louis, all of Mo.

[73] Assignee: ACF Industries, Incorporated, Earth City, Mo.

[21] Appl. No.: 403,318

[22] Filed: Sep. 6, 1989

[51] Int. Cl.[5] ..... B60P 7/08

[52] U.S. Cl. ..... 410/58; 410/56

[58] Field of Search ..... 410/56, 57, 58, 59, 410/60, 61, 62, 63, 64

[56] References Cited

U.S. PATENT DOCUMENTS 4,225,276 9/1980 Stoller et al. ..... 410/64

*Primary Examiner*—George E. A. Halvosa
*Assistant Examiner*—Mark T. Le
*Attorney, Agent, or Firm*—Polster, Polster and Lucchesi

[57] ABSTRACT

A retractable trailer hitch (1) for use on an intermodal railcar (C) supports an over-the-road trailer (T) of the railcar when the hitch is in its raised position. The hitch includes a hitch head (3) which is releasably securable to the king pin (K) of the trailer. The hitch head is supported by a first or generally vertical support strut (9) and by a second or a diagonal support strut (7), both of these struts being pivotally connected to the hitch head. The lower end of the first strut is pivotally secured in fixed position to the railcar and the lower end of the second strut is selectively locked in a fixed position with respect to the railcar when the hitch is in its raised position. A latch mechanism is carried on the lower end of the second strut so as to positively maintain the hitch in its raised position. The latch mechanism may be manually operated by a train attendant from the side of the car clear of the hitch so as to unlock the hitch and to permit movement of the hitch from its raised to its retracted position.

18 Claims, 4 Drawing Sheets

RETRACTABLE RAILCAR HITCH

BACKGROUND OF THE INVENTION

This invention relates to an over-the-road trailer hitch for use on intermodal railcars, and, more particularly, to such a hitch for use on a "spine type" intermodal railway car which is utilized to transport both over-the-road trailers and large shipping containers.

Trailer hitches for use on intermodal railway cars are well known in the art. Typically, these trailer hitches are used on so-called "piggy back" intermodal railcars to secure over-the-road trailers on the railcar. In recent years, railroads have developed large terminals for handling intermodal shipments in which the trailers are lifted on and off the car either by means of a bridge crane straddling the track, or by means of large fork lifts or the like. In certain applications, to give shippers additional flexibility, such intermodal cars are designed to handle large containers as well as over-the-road trailers. So that the railcar may have this dual use capability, it is necessary that the trailer hitch be retractable so that it will not interfere with the container when the railcar is used to transport containers. Typically, these retractable hitches are moved from their lowered or retracted position to their erected or raised position either manually through use of a manually operated screw jack mechanism or the like, or are erected using the crane to lift the retracted hitch.

Typically, a retractable hitch includes a first or generally vertical strut and a second or diagonal strut. The upper ends of these struts are pivotally connected to a hitch head which serves as a fifth wheel for supporting the front end of the trailer and for positively holding the trailer on the railcar. The hitch head includes releasable jaws or the like for positively engaging the king pin of the trailer. The hitch is typically the only means holding the trailer in place on the railcar when it is underway. At its destination, the hitch head is actuated so as to release the trailer kingpin thereby to permit the trailer to be offloaded.

In addition to the manually operable or crane operable retractable hitch described above, another known hitch is referred to as a tractor operated hitch. As an alternative to utilizing a crane or other lifting equipment to load and off-load trailers from an intermodal railway car, it is well known to use a "circus" loading/off-loading technique in which a trailer coupled to a tractor is driven lengthwise onto the railcars and from one car to another until reaching a desired position. The tractor engages a retracted hitch on the car, raises the hitch, and transfers the trailer from the tractor to the raised hitch. Likewise, in off-loading a trailer, the tractor actuates a retraction mechanism for the hitch and transfers the trailer from the hitch to the tractor while permitting the hitch to move to its retracted position. Examples of prior art crane operated and tractor operated hitches, and of hitch heads are shown in the following U.S. Pat. Nos. 4,185,564, 4,193,350, 4,216,726, 4,221,397, 4,225,276, 4,230,430, 4,230,431, 4,239,429, 4,264,250, 4,397,594, 4,407,617, and 4,563,117.

In recent years, an intermodal railcar has been developed which is referred to as a "spine-type" car which has a center through sill beam extending the length of the car with intermittent platforms provided at the sides of the car for supporting the wheels of an over-the-road trailer. A hitch is provided on the spine structure of the car for supporting the forward end of the trailer. Typically, each intermodal spine-type car carries five (5) over-the-road trailers. These spine-type cars may also be utilized to carry containers, for which use the hitch must be retracted.

In accordance with this invention, a manually operable release mechanism is provided for a retractable hitch which may be operated by a train attendant standing alongside of the car. When the release mechanism is actuated, the hitch is free to move toward its retracted position under the bias of gravity. Because such hitches are heavy (e.g., 1500 lbs. or more), the hitch will rapidly move to its retracted position with great force. Thus, these hitches, as they are falling toward their retracted position, can cause physical injury to a train attendant not clear of the hitch and the hitch can cause damage to the railcar or to the hitch due to the impact during falling movement.

SUMMARY OF THE INVENTION

Among the several objects and features of this invention may be noted the provision of a retractable trailer hitch for railcars in which the hitch, when in its raised or erected position, is positively locked in position so as to securely hold and support an over-the-road trailer thereon;

The provision of such a hitch which is readily erected using a crane or the like;

The provision of such a hitch which is easily retracted by personnel standing on the ground away from the hitch;

The provision of such a hitch which is retractable from either side of the railcar;

The provision of such a hitch which, when unlocked, is movable to its retracted position under its own weight;

The provision of such a hitch in which its movement toward its retracted position is retarded a sufficient amount of time to allow personnel to move clear of the hitch; and The provision of such a hitch in which certain components of the hitch are covered to prevent personnel from inadvertently coming into contact therewith, especially while the hitch is raised and lowered.

Briefly stated, a retractable trailer hitch of the present invention is for use on a railroad car. A first support has one end pivotally mounted to the railcar. A second support has one end movable in a horizontal direction between a first or hitch erect position and a second or hitch retracted position. The first support is generally vertical when the hitch is in its erect position and the second support extends generally diagonally between the upper end of the first support and the railcar when the hitch is erect. A hitch head is carried on the respective opposite ends of the first and second supports and is elevated above the railcar when the hitch is erect. The hitch head engages a portion of a trailer set upon the deck to hold it in place during movement of the railcar. Locking means latches the second support in its first position, this locking means being biased in its latched position. The hitch has manually operable unlatching means for overcoming the bias of the locking means and for moving the locking means from its latched position to enable movement of the hitch to its retracted position. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
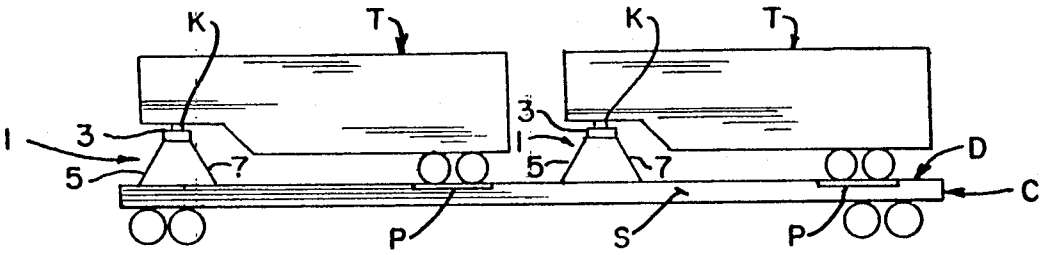
FIG. 1 is a representation of a spine-type intermodal railcar for transporting trailers and illustrates two hitches of the present invention installed thereon.

Referring to the drawings, a retractable trailer hitch of the present invention is indicated generally at 1. As shown in FIG. 1, hitch 1 is for use on an intermodal railroad car C of a type used to transport over-the-road trailers T. Car C is a "spine" type railcar having an elongate center through sill or beam S extending lengthwise of the car and having an upper surface constituting a deck D. Car C is sufficiently long such that multiple (e.g., 5) trailers T are transportable on the car, the front of each trailer being supported by a respective hitch 1, as shown in FIG. 1, only two trailers T are shown on car C. On opposite sides of the center through sill S, intermittent platforms P are provided for supporting to wheels of trailers T. As is well known in the art, trailers T are preferably hoisted onto car C so that their wheels rest on platforms P and so that the front of the trailer is supported on a respective hitch 1. However, within the broader aspects of this invention, those skilled in the art will recognize that hitches 1 of the present invention may be utilized with drive on-drive off intermodal railcars as well.

Hitches 1 are preferably erected prior to loading trailers on the car. The hitches have a hitch head 3 used to capture and hold a king-pin K of the trailer and to support the front of the trailer during its transport. At its destination, the king-pin is released and the trailers off-loaded. With respect to the erection of a railcar hitch, reference may be made to the co-assigned U.S. Pat. No. 4,264,250 which is incorporated herein by reference. With respect to the design of hitch heads for capturing and holding the king-pin of a trailer, reference may be made to the following co-assigned U.S. Pat. Nos. 4,563,117, 4,397,594, 4,221,397, and 4,193,350 all of which are also incorporated herein by reference.

Figure 2:
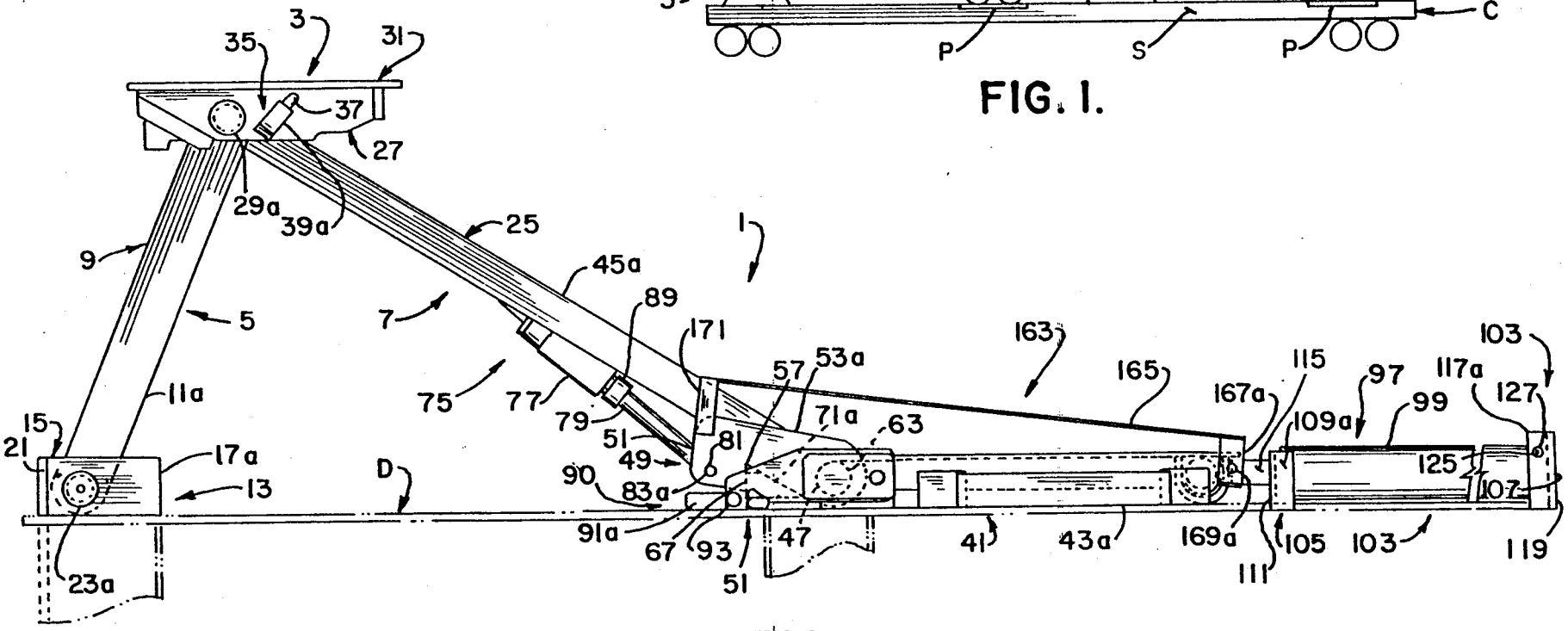
FIG. 2 is a side elevational view of the hitch in its erect or raised position.

Referring to FIG. 2, hitch 1, whose components are axially aligned with the longitudinal centerline of car C, includes a first support means 5 and a second support means 7 for supporting hitch head 3. Means 5 comprises a generally vertical strut 9, one end of which is pivotally mounted to deck D of railcar C. Strut 9 has a pair of parallel, spaced apart legs 11*a* and 11*b*. Respective ends of each leg are received in a mounting means 13 which comprises a lug assembly 15. The lug assembly is attached to deck D and aligned so as to permit pivotal movement of the first support means about an axis perpendicular to the longitudinal axis of the railcar as hitch 1 is moved between its erected and retracted positions. The lower end of each strut leg 11*a*, 11*b* received in lug assembly 15 is fitted in a pocket formed by a sidewall 17*a*, 17*b*, respectively, of the lug assembly and a bracket 19*a*, 19*b*, respectively, which extends rearwardly from and perpendicular to a front plate 21 of the lug assembly. A respective strut pin 23*a*, 23*b* extends through corresponding openings in the sidewall, strut leg and bracket to pivotally mount strut 9 to the deck so the strut can be raised and lowered.

Figure 5:
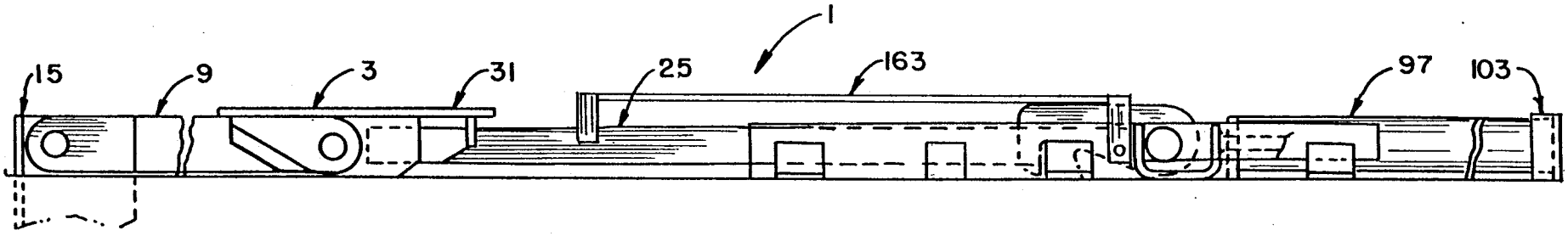
FIG. 5 is a side elevational view of the hitch in its fully retracted position.

Second support means 7 comprises a diagonal strut 25, one end of which is translatable in a horizontal direction over the deck and which is pivotal about a transverse, horizontal axis as it is translated longitudinally of the car between a first or hitch erect position (i.e., the FIG. 2 position) and a second or hitch retracted position (i.e., see FIG. 5). As shown in FIG. 2, strut 9 is generally vertical (but leans somewhat toward diagonal strut 25) when the hitch is in its erect position and strut 25 extends generally diagonally between the upper end of strut 9 and the deck when the hitch is erect.

Figure 3:
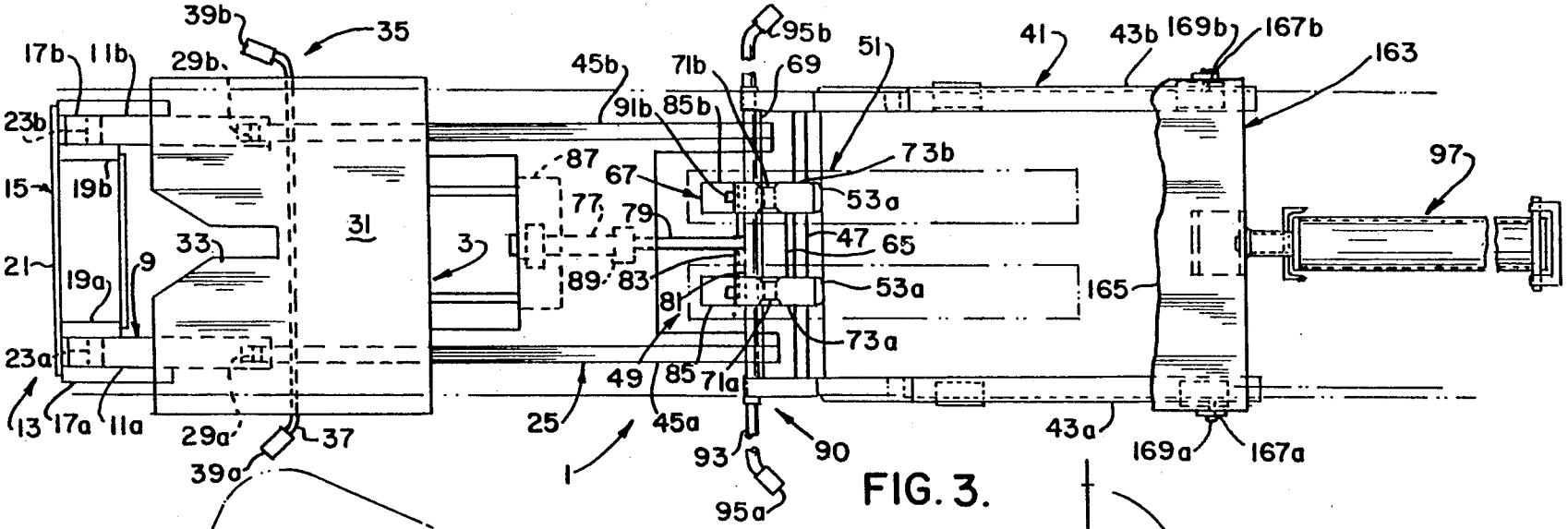
FIG. 3 is a top plan view of the hitch in its erect position.

Hitch head 3 is commonly pivotally carried on the respective opposite ends of struts 9 and 25 and, as noted, is elevated a required distance above deck D when the hitch is erect. Since the hitch head structure is fully described in the above mentioned patents incorporated herein by reference and is commercially available from the assignee of the present invention under its trade designation Model 6, the construction of the hitch head will not be given in detail. The hitch head does include a head weldment 27 which is pivotally connected to the upper ends of struts 9 and 25 by respective strut pins 29*a*, 29*b*. The weldment includes a top plate 31 having a notch 33 (see FIG. 3) extending rearwardly from the front of the weldment. The notch receives king-pin K (see FIG. 1). Hitch head 3 has operable and closable jaws (not shown) which grip king-pin K to hold trailer T in place during movement of the railcar. A handle assembly 35 includes a rod 37 extending crosswise of the weldment beneath plate 31. The rod projects outwardly beyond both sides of the hitch head and is downwardly turned at its respective outer ends. A socket 39*a*, 39*b* is formed at each outer end of the rod for rail yard personnel to insert a tool (not shown) in either socket. By rotating rod 37 with the tool, the king-pin jaws released to permit off loading of the trailer from the railcar. It will be appreciated that the king-pin may be released by turning rod 37 from either side of the railcar.

With respect to strut 25, a guide assembly 41 has parallel, spaced apart guide rails 43*a*, 43*b*, respectively, extending parallel to the longitudinal axis of the car. The rails are each mounted on deck D and are of an inverted L configuration when installed. Strut 25, like strut 9, has a pair of parallel spaced apart legs 45*a* and 45*b*. A guide pin 47 extends between these legs and projects outwardly beyond them. The ends of guide pin 47 are received in the respective guide rails 43*a*, 43*b* and permit horizontal, axial translation movement of the lower end of strut 25 between the hitch erect and the hitch retracted positions.

Hitch 1 includes a locking means 49 for locking diagonal strut 25 and hitch 1 in the hitch erect position.

Means 49 includes a hook assembly 51 comprising a pair of plates 53*a* and 53*b*, respectively. The plates are identical in construction. Each has a leading edge 55 which is curved at its lower end. Intermediate the length of each of the plates 53*a*, 53*b*, a notch 57 is formed which extends upwardly from the base of the plate. The forward edge 59 of the notch rises vertically from the base of the plate, while its trailing edge 61 slopes rearwardly. At the rear of each plate is a transverse bore 63 for the plates to be mounted on pin 47 between the legs of strut 25. A plate 65 extends between the respective inner walls of the plates and is secured to each, as, for example, by welding.

Locking means 49 further includes a latch lug 67 which is mounted to the deck D of the railcar. The latch lug has a base plate 69 which extends between the guide rails at the forward end thereof. A pair of upwardly extending, generally triangularly shaped latch members 71*a*, 71*b* are secured to the top of base plate 69. The spacing of the members on the plate corresponds to that of latch plates 53*a*, 53*b*. The shape of the latch members 71*a*, 71*b* corresponds generally to the shape of the notches 57 formed in the plates 53*a*, 53*b*, except the upper end of each latch member is truncated. The rear face 73*a*, 73*b* of each latch members 71*a*, 71*b* thus forms a ramp up which the leading edge of the respective plates are drawn as the hitch is erected. When forward movement of strut 25 pulls hook assembly 51 over base 69, the notches in plates 53*a*, 53*b* are captured by the respective latch members.

A bias means 75 acts to bias latch hook plates 53*a*, 53*b* toward their latched positions thereby to maintain hitch 1 in its hitch erect position. The bias means includes a compression spring 77 which is mounted on a bar 79. The lower end of the bar (as shown in FIG. 2) fits between plates 53*a*, 53*b* of hook assembly 51. A pin 81 is inserted through a sleeve 83 at the base of the bar and the ends of the pin are received in corresponding openings 85*a*, 85*b*, respectively, in plates 53*a*, 53*b*. The upper end of the bar is attached to a clevis assembly 87 which, in turn, is attached to legs 45*a*, 45*b* of strut 25. One end of spring 77 bears against the clevis assembly, while the other end of the spring bears against an annular seat 89 formed on the bar. The spring force is transmitted to plates 53*a*, 53*b* to urge the plates rearwardly and downwardly against the latch members thereby to prevent unlocking of the hitch in service.

Figure 6:
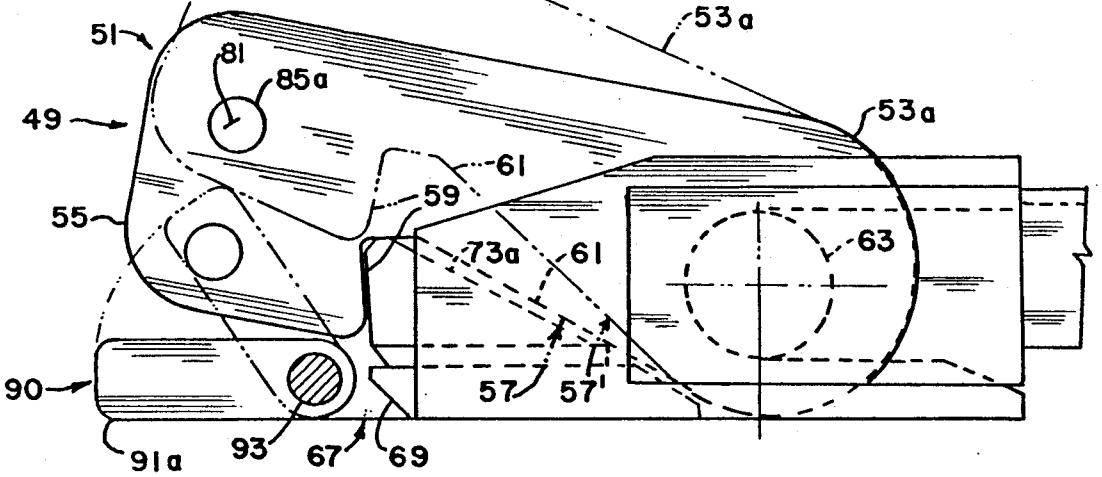
FIG. 6 is a side elevational view of the latching and release mechanism for the hitch.

The hitch, as noted, is maintained in its erect position during transport of a trailer from its origin to its destination. Once there, and after the trailer has been offloaded, hitch 1 may be retracted to its position shown in FIG. 5. For this purpose, the hitch includes a manually operable means 90. Means 90 includes a pair of cams 91*a*, 91*b*, respectively, each of which is attached to a release rod 93. Rod 93 extends transversely of the railcar and is pivotally mounted to the railcar deck D. As shown in FIG. 6, the rod is mounted forward of base plate 69 and the cams are positioned on the shaft so to be immediately below the respective plates 53*a*, 53*b*. The length of rod 93 is such that the ends of the rod extend beyond the sides of the hitch. The ends of the rod are bent and terminate in respective sockets 95*a*, 95*b*. A yardman standing on the track bed adjacent railcar C can readily insert a tool in either socket and rotate the rod. Clockwise rotation of the rod, as viewed in FIG. 6, moves the cams against the forward end of their associated plates 53*a*, 53*b* to lift the plates and also aids rearward movement of the lower end of diagonal strut 25 upon initiation of retraction of the hitch. When the bottom edge of the plates clear the top of the latch members, retraction of the hitch commences.

Given the weight of hitch 1, which is approximately 1,500 pounds, it is desirable that the hitch not retract instantaneously upon the release of plates 53*a*, 53*b*. Rather, retraction of the hitch should take place over a reasonable amount of time so as to permit personnel to move clear of the hitch and so as to prevent damage to the hitch. For this purpose, a retarder 97 is provided with the hitch. Retarder 97 comprises a cylinder 99 in which a piston 101 is movable. The cylinder is fixedly mounted to the deck of the railcar and the piston is attached to strut 25 for movement of the piston with the strut.

Figure 7:
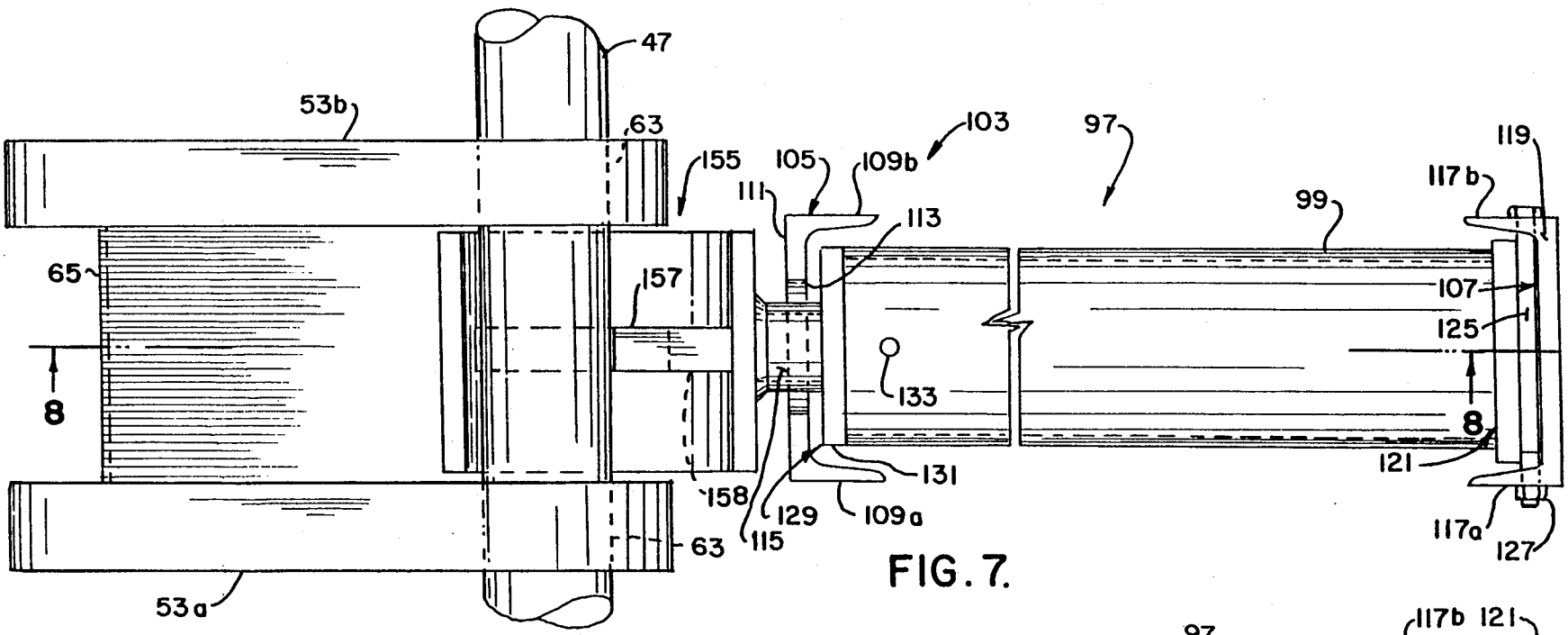
FIG. 7 is a top plan view of a hitch retarder.
Figure 8:
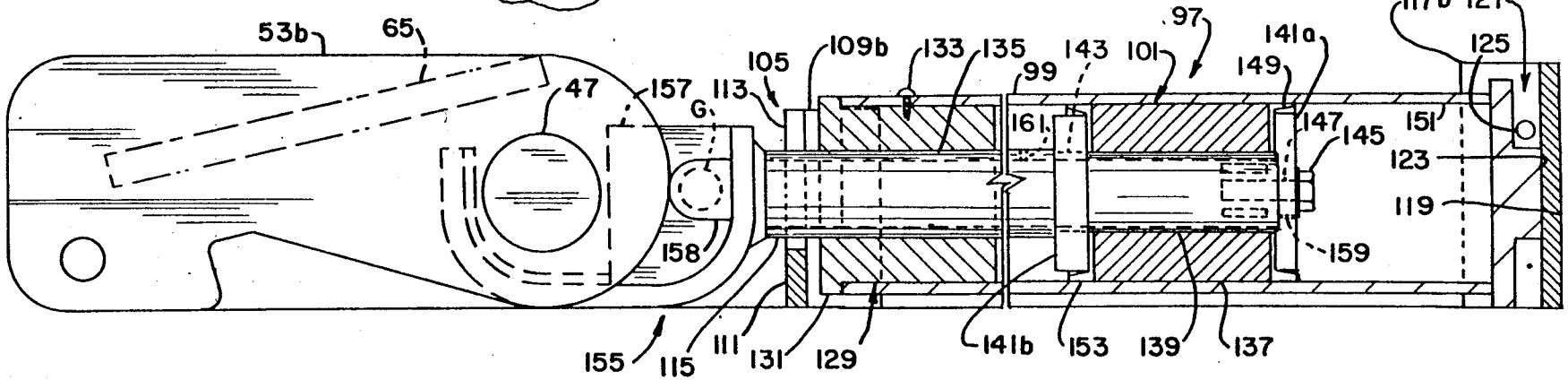
FIG. 8 is a longitudinal sectional view taken along line 8—8 in FIG. 7; and, FIG. 9 is a graph illustrating the retraction rate of the hitch using the retarder.

Referring to FIGS. 7 and 8, retarder cylinder 99 is axially mounted along the longitudinal centerline of the railcar deck D. A support means 103 for the retarder cylinder includes a forward support 105 and a rear support 107. Support 105 is U-shaped in plan having rearwardly extending side walls 109*a*, 109*b*, and an end wall 111. A notch 113 extends downwardly from the upper end of wall 111 to provide an aperture through which a piston rod 115 extends. Support 107 is also U-shaped in plan having forwardly extending side walls 117*a*, 117*b*, and an end wall 119. A cap 121 fits over the end of cylinder 99 adjacent support 107. The cap has a boss 123 on its outer face which bears against the inner face of end wall 119 for transferring axial loads to which the retarder is subjected. A bolt 125 extends between side walls 117*a*, 117*b* at a immediately point above the boss to capture the cylinder in place and prevent any upward dislodging movement of the retarder doing hitch operation. A nut 127 secure the bolt in place.

The other end of cylinder 99 is sealed by a cap 129 having an outer circumferential flange 131 fitting over the end wall of the cylinder. A screw 133 attaches the cylinder and cap. The cap has a central, longitudinal bore 135 sized to accommodate rod 115. Piston 101 comprises a wear bearing 137 having a central, longitudinal bore 139 through which the inner end of the rod extends. End plates 141*a*, 141*b* fit over the respective ends of the wear bearing and plate 141*b* has a central opening 143 through which the rod fits. The inner end of the rod abuts the inner face of end plate 141*a* and the end of the rod is threaded for a screw 145 to be threaded through an opening 147 in the end plate and attach the end plate to the rod. A fluid seal 149 is sandwiched between plate 141*a* and the piston. The seal forms a fluid seal between the piston and the inner wall 151 of cylinder 99. Wall 151 is preferably of an extruded material and a second seal 153 is sandwiched between plate 141*b* and the piston, at the other end of the piston, to wipe down the cylinder wall and keep the bore of the cylinder clean as the piston reciprocates in the cylinder.

The outer end of rod 115 is attached to one end of a U-shaped hook 155 by which the retarder is connected to pin 47 of strut 25. The width of the hook is less than the distance between the inner faces of plates 53*a*, 53*b*, for the hook to fit between the plates on the pin. Thus, piston 101 is movable back and forth in a horizontal direction as the strut moves to erect and retract hitch 1. An upstanding rib 157 extends forwardly from the inner face of the rear wall of the hook. The length of the rib is such as to leave a gap between the forward end of the rib and the inner face of the front wall of the hook which is slightly greater than the diameter of pin 47. This allows the pin to fit in the hook between the rib and forward wall of the hook. A horizontal slot 158 in rib 157 extends approximately one-half the length of the rib. The centerline of the slot corresponds to that of rod 115 and the height of the slot is sufficient for a tool such as a gag bar G (see FIG. 8) to be inserted between rails 43*a*, 43*b*, through the slot. The gag bar is used when the hitch is being serviced and prevents movement of strut 25 during such service. Upon completion of service, the gag bar is removed.

Figure 9:
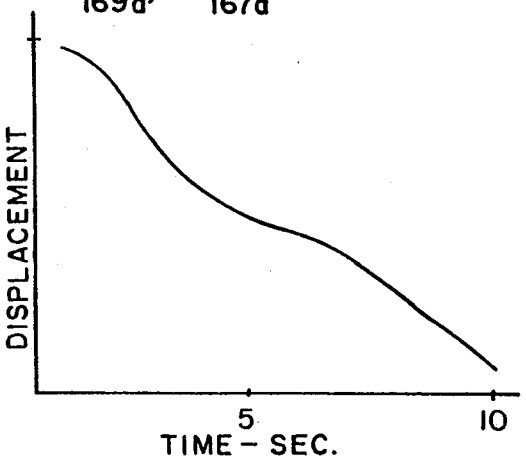
Figure 4:
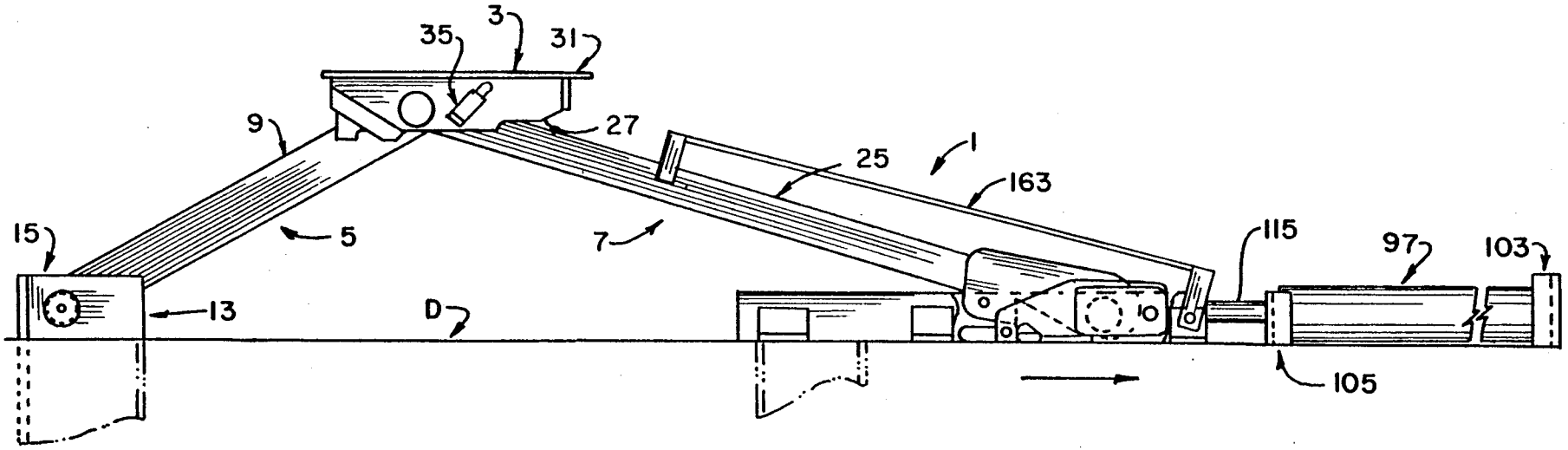
FIG. 4 is a side elevational view of the hitch in a partially retracted position as it moves toward its retracted position.

Rod 115 is hollow, and a first bleed hole 159 is formed in the inner end of the rod where it attaches to end plate 141*a*. A second bleed hole 161 extends through the side wall of the rod at a point adjacent the opposite end of piston 99. The diameter of the bleed holes is such as to determine the retraction time imposed on hitch 1 by the retarder. Referring to FIG. 9, the retraction of the hitch versus time is plotted. With hitch 1 erected, rod 115 is pulled fully to the left as viewed in FIG. 1. Upon disengagement of plates 53*a*, 53*b*, from latch members 71*a*, 71*b* as previously described, the weight of the struts and hitch head forces piston 115 to the right as viewed in these drawings. Movement of piston 99 compresses air in the cylinder until the pressure counteracts the force on the piston created by the weight of the hitch. At that point, there is a pause in the retractive movement of the hitch. The compressed air in the end of the cylinder now bleeds out through holes 159 and 161; and, when sufficient air has bled, the weight of the hitch components again causes retractive movement of the hitch. The intermediate point in hitch retraction is shown in FIG. 4, and that point corresponds to the "knee" in the graph of FIG. 9. The result is a minimum retraction time for the hitch of approximately 3 seconds, and preferably a retraction time of between 5–9 seconds. Of course, those skilled in the art will recognize that by varying the diameter of metering bleed holes 159 and 161, and by changing the kimematic linkages of hitch 1, the amount of retardation and the shape of FIG. 9 may be varied.

To protect the latching components of the hitch from structural damage and to keep personnel clear of the hitch and retarder as the hitch is raised and lowered, a cover 163 overlying the retarder is provided. The cover comprises a rectangular plate 165 whose width corresponds generally to that of strut 25. The plate is pivotally attached to side rails 43*a*, 43*b* at a point adjacent the rear end of strut 25 when the hitch is retracted. Tabs 167*a*, 167*b* respectively extend downwardly from the sides of the plate at the rear end thereof. The tabs are attached to the outer face of the respective side rails by pins 169*a*, 169*b*. A length of the plate corresponds to the distance between the end of the strut when the hitch is retracted and the forward end of plates 53*a*, 53*b*. A second pair of tabs 171, only one of which is shown in the drawings, extend downwardly from the side of the plate at his forward end and serve to maintain the plate in its proper position relative to strut 25 and to prevent the cover plate from being lifted by the airstream as the car is transported over the rails. It will be noted that the plate does not remain adjacent the outer face of strut 25 throughout operation of the hitch. As shown in FIG. 4, the plates moves away from the strut as it is raised and lowered; however, as shown in FIGS. 2 and 5, when the hitch is fully erect or fully retracted, the plate rests against the strut.

In view of the above, it will be seen that the several objects and features of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A retractable trailer hitch for use on a railcar, said hitch being movable between a first or hitch erect position and a second or hitch retracted position, said hitch comprising:

first support means, one end of which is pivotally mounted to the railcar for movement between said hitch erect and retracted positions;

second support means, one end of which is movable in a horizontal direction as said hitch is moved between its said hitch erect and hitch retracted positions, said first support means being generally vertical when the hitch is in its erect position and said second support means extending generally diagonally when the hitch is erect;

a hitch head carried on the respective other ends of the first and second support means, said hitch head being elevated above the railcar when the hitch is in its hitch erect position and engaging a portion of a trailer loaded on the railcar to hold it in place during movement of the railcar;

means for locking said second support means and said hitch in said hitch erect position;

means for biasing said locking means in its locking position thereby to maintain said second support means and said hitch in said hitch erect position; and, manually operable means for overcoming said biasing means and moving said locking means from its locking position to enable retraction of the hitch, said manually operable means including a cam acting on said locking means to move the latter from its locking position in which said second support means and said hitch are maintained in said hitch erect position and an unlocking position in which said second support means is free to move in horizontal direction toward said hitch retracted position whereby the weight of said first and second support means and said hitch head facilitates retraction of said hitch, said cam being attached to a rod extending generally laterally of the car and being manually operable from the side of the railcar whereby the operator is at a distance from the hitch when it retracts.

2. The hitch of claim 1 wherein the first support means comprises a first strut and the second support means comprises a second strut, the first strut being set at an angle off vertical when the hitch is in its erect position whereby the hitch retracts under the weight of the struts and the hitch head when the locking means is unlocked.

3. The hitch of claim 2 further including mounting means attached to the car for pivotally mounting the first strut to the car.

4. The hitch of claim 2 further including guide means attached to the car for guiding movement of said one end of the second strut.

5. The hitch of claim 1 wherein the second support means comprises a strut having one end movable generally horizontally with respect to said car and said locking means comprises a locking plate connected to the movable end of the strut.

6. The hitch of claim 5 wherein the locking means further includes a latch for capturing said locking plate as the one end of the strut moves horizontally with respect to said car.

7. The hitch of claim 5 wherein the strut comprises a pair of parallel, spaced apart legs, and said locking means further comprises a pair of parallel, spaced apart locking plates, said locking plates positioned between the legs with each plate being captured by the latch.

8. The hitch of claim 7 further including a pin extending transversely of the centerline of the car between the legs, the plates being mounted on the pin.

9. The hitch of claim 8 wherein the latch comprises an upwardly projecting generally triangular shaped latch for each plate, each latch being mounted on the deck for each plate to move over its associated latch as the strut moves in the direction to erect the hitch, each plate having a curved leading edge to facilitate movement of the plate over its associated latch and a notch intermediate its length and extending upwardly from the base thereof, each notch dropping onto its associated latch as the hitch reaches its erect position for the latches to capture the plates.

10. The hitch of claim 6 wherein the biasing means includes a spring urging said locking plates against the latch.

11. The hitch of claim 10 wherein the plate is connected to the strut, the locking means includes an upwardly projecting generally triangular shaped latch mounted on said car, each said locking plate having a notch formed in the base thereof intermediate its length in which the latch is received, and the spring has one end connected to the strut and its other end bearing against the plate to urge the plate against the latch.

12. The hitch of claim 11 wherein the manually operable means includes means for moving the plate away from the latch.

13. A retractable trailer hitch for use on a railcar and movable between a first or hitch erect position and a second or hitch retracted position, comprising:

a hitch head engaging a portion of a trailer set upon the deck to hold it in place during movement of the railcar;

a first strut one end of which is pivotally mounted to a deck of the railcar for raising and lowering the strut, and the other end of which is attached to the hitch head and elevated when the hitch is erect;

a second strut one end of which is movable in a horizontal direction over the deck as the hitch is moved between its erect and retracted positions, and the other end of which is also attached to the hitch head and elevated when the hitch is erect, the first strut being set at an angle off vertical when the hitch is erect and the second strut extending generally diagonally between the elevated hitch head and the deck;

means for locking the second strut in the hitch erect position and including a pair of parallel, spaced apart plates attached to the first said end of the second strut for movement therewith, and a latch for each plate, each plate having a notch extending upwardly from the base thereof, and the latch including an upwardly projecting latch for each plate, each plate being drawn over its associated latch as the second strut moves during erection of the hitch for the respective notches to be captured by the latches;

means including a compression spring for biasing the second strut and the hitch in the hitch erect position, said spring urging said plates against their associated latches; and, manually operable means for overcoming the bias means and moving said locking means from its locking position to enable retraction of the hitch, a said manually operable means including a cam acting on each plate to raise the plate off its associated latch whereby the hitch retracts under the weight of the struts and the hitch head, a rotatable rod on which the cams are mounted, and socket means located at each end of the rod for manual insertion of a tool for rotating the rod in a direction for the cams to lift the plates.

14. A retractable trailer hitch for use on a railcar, said hitch being movable between a first or hitch erect position and a second or hitch retracted position, said hitch comprising:

first support means, one end of which is pivotably mounted to the railcar for movement between said hitch erect and retracted positions;

second support means, one end of which is movable in a horizontal direction as said hitch is moved between its said hitch erect and hitch retracted positions, the second support means comprising a strut having one end movable generally horizontally with respect to said car, said first support means being generally vertical when the hitch is in its erect position and said strut extending generally diagonally when the hitch is erect;

a hitch head carried on the respective other ends of the first and second support means, said hitch head being elevated above the railcar when the hitch is in its hitch erect position and engaging a portion of a trailer loaded on the railcar to hold it in place during movement of the railcar;

means for locking said strut and said hitch in said hitch erect position, the locking means including a locking plate connected to the movable end of the strut and a latch for capturing the plate as the one end of the strut moves horizontally with respect to said car;

means for biasing said locking means in its locking position thereby to maintain said strut and said hitch in said hitch erect position, the biasing means including a spring urging the plate against the latch, said latch being an upwardly projecting generally triangular shaped latch mounted on said car, the plate having a notch formed in the base thereof intermediate its length in which the latch is received, the spring having one end connected to the strut and its other end bearing against the plate to urge the plate against the latch; and, manually operable means for overcoming said biasing means and removing said locking means from its locking position to enable retraction of the hitch, said manually operable means including a cam acting on one end of the plate to lift the plate of the latch whereby the weight of the first and second support means and the hitch head will retract the hitch, the cam being attached to a rod extending outwardly toward the side of the car, the outer end of the rod having a socket for insertion of a tool by which the rod is rotated to have the cam act on the plate and lift it thereby to move the plate away from the latch.

15. The hitch of claim 14 wherein the strut comprises a pair of parallel, spaced apart legs, and the locking means comprises a pair of parallel, spaced apart plates positioned between the legs, with each plate being captured by the latch.

16. The hitch of claim 15 further including a pin extending transversely of the center line of the car between the legs, the plates being mounted on the pin.

17. The hitch of claim 16 wherein the latch comprises an upwardly projecting generally triangular shaped latch for each plate, each latch being mounted on the deck for each plate to move over its associated latch as the strut moves in the direction to erect the hitch, each plate having a curved leading edge to facilitate movement of the plate over its associated latch and a notch intermediate its length and extending upwardly from the base thereof, each notch dropping onto its associated latch as the hitch reaches its erect position for the latches to capture the plates.

18. A retractable trailer hitch for use on a railcar, said hitch being movable between a first or hitch erect position and a second or hitch retracted position, said hitch comprising:

first support means, one end of which is pivotally mounted to the rail car for movement between said hitch erect and retracted positions;

second support means, one end of which is movable in a horizontal direction as said hitch is moved between its said hitch erect and hitch retracted positions, said first support means being generally vertical when the hitch is in its erect position and said second support means extending generally diagonally when the hitch is erect;

a hitch head carried on the respective other ends of the first and second support means, said hitch head begin elevated above the railcar when the hitch is in its hitch erect position and engaging a portion of a trailer loaded on the railcar to hold it in place during movement of the railcar;

means for locking said second support means and with it, said hitch in said hitch erect position, said locking means including a hook plate connected to the movable end of said second support means and a latch for capturing the hook plate;

means for biasing said locking means in its locking position thereby to maintain said second support means and said hitch in said hitch erect position; and, manually operable means for overcoming said biasing means and moving said locking means from its locking position to enable retraction of the hitch, said manually operable means including a cam acting on the plate to lift it off the latch, and a rod to which the cam is attached, the rod extending outwardly toward a side of the car and having a socket in its outer end for insertion of a tool to rotate the cam to lift the hook plate.

* * * * *